US005654998A

United States Patent [19]

Turcu et al.

[11] Patent Number: 5,654,998

[45] Date of Patent: Aug. 5, 1997

[54] LASER-EXCITED X-RAY SOURCE

[75] Inventors: Ion Christian Edmond Turcu, Wantage; Ian Norman Ross, South Hinksey, both of England; Fergus O'Neill, Lurgan, Ireland

[73] Assignee: Council for the Central Laboratory of the Research Councils, Oxon, England

[21] Appl. No.: 545,637

[22] PCT Filed: Apr. 29, 1994

[86] PCT No.: PCT/GB94/00928

§ 371 Date: Oct. 30, 1995

§ 102(e) Date: Oct. 30, 1995

[87] PCT Pub. No.: WO94/26080

PCT Pub. Date: Nov. 10, 1994

[30] Foreign Application Priority Data

Apr. 30, 1993 [GB] United Kingdom ..... 9308981

[51] Int. Cl.[6] ..... H05G 2/00

[52] U.S. Cl. ..... 378/119; 378/120

[58] Field of Search ..... 378/119, 120, 378/143

[56] References Cited

U.S. PATENT DOCUMENTS 4,731,786 3/1988 Macgowan et al. .
5,175,757 12/1992 Augustoni et al. .
5,539,764 7/1996 Shields et al. ..... 372/70 X

FOREIGN PATENT DOCUMENTS 0181194 5/1986 European Pat. Off. .

OTHER PUBLICATIONS

O'Neill et al., "X-Ray Emission From Plasmas Generated By An XeCl Laser Picosecond Pulse Train", Appl. Phys. Lett. (Dec. 1989) 55 (25) pp. 2603–2604.

Turcu et al., "100 Hz KrF Laser–Plasma X–Ray Source", SPIE vol. 1503 Excimer Lasers and Applications III (1991) pp. 391–405.

Microelectronic Engineering, vol. 21, No. 1/4, 1 Apr. 1993, Amsterdam NL, pp. 95–98 I.C.E. Turcu et al "X–ray Lithography with Efficient Picosecond KrF Laser–Plasma Source at 1 NM Wavelength".

Soviet Journal of Quantum Electronics, vol. 21, No. 3, 1 Mar. 1991, New York U.S. pp. 248–249, S.A. Akhmanov et al. "Generation of Picosecond X–Ray Pulses in a Dense Plasma Created by High–Power Femtosecond Laser Pulses of the 308 NM Wavelength".

IEEE Journal of Quantum Electronics, vol. 25, No. 12, 1 Dec. 1989, New York US, pp. 2417–2422, M.M. Murnane et al "Generation and Application of Ultrafast X–Ray Sources".

Applied Physics Letters., vol. 60, No. 18, 4 May 1992, New York US, pp. 2195–2197 G.A. Kyrala et al "X–Ray Generation by High Irradiance Subpicosecond Lasers".

Journal of Applied Physics, vol. 71, No. 1, 1 Jan. 1992, New York US. pp. 85–93 D. Xenakis et al "Laser–Plasma X–Ray Generation Using an Injection–Mode–Locked Xecl Excimer Laser" cited in the application.

Applied Physics Letters, vol. 63, No. 22, 29 Nov. 1993, New York US, pp. 3046–3048 I.C.E. Turcu et al "Efficient Kev X–Ray Emission From Plasmas".

*Primary Examiner*—David P. Porta
*Attorney, Agent, or Firm*—Cushman, Darby & Cushman, IP Group of Pillsbury Madison & Sutro LLP

[57] ABSTRACT

A laser-excited X-ray source in which the efficiency of conversion of laser energy into X-ray energy, and the average X-ray output power, are increased by providing laser light, which is focussed on a target to generate X-rays, in the form of trains of very short pulses with a pulse duration in the range 1–10 picoseconds. Preferably it is arranged such that successive pulses in a train are focussed at adjacent but different points on the target.

19 Claims, 10 Drawing Sheets

LASER-EXCITED X-RAY SOURCE

This application claims benefit of international application PCT/GB94/00928, filed Apr. 29, 1994, published as WO94/26080 Nov. 10, 1994.

FIELD OF THE INVENTION

This invention relates to laser-excited X-ray sources and, in particular, to a laser-plasma X-ray source having a target which is irradiated by the output of a suitable laser, preferably an excimer laser.

BACKGROUND OF RELATED ART

Such X-ray sources have been employed in applications such as X-ray spectroscopy, X-ray lithography, radiobiology and X-ray microscopy, and an X-ray source of this kind has been described in considerable detail in a paper entitled "100 Hz KrF Laser-Plasma X-ray Source" presented at a conference entitled "Excimer Lasers and Applications III" at The Hague, Netherlands in 1991 and published in the Proceedings of SPIE—The International Society for Optical Engineering (SPIE Vol. 1503 Excimer Lasers and Applications III (1991), 391–405). As there described, an X-ray source comprises an excimer laser system which generates UV light pulses, at a repetition rate up to 100 Hz, which are focused on to an X-ray target. The target consists of a tape of suitable material, such as copper, steel or mylar, chosen in dependence on the desired frequency of the X-rays to be generated, and a tape transport mechanism which moves the tape so that each light pulse impinges on a fresh part of the tape, undamaged by previous pulses. Each light pulse, impinging on the tape, generates at the tape surface a highly localized volume of plasma which emits the desired X-rays but also has the effect of attenuating the UV light and shielding the tape from it, and thereby limiting the duration of the period in which X-rays are emitted. The incident UV light also causes debris to be ejected from the tape, and the debris tends to settle on surfaces of the optical system which delivers the UV light pulses to the tape and thus reduce the intensity of the incident light. As described in the above-mentioned paper, attempts to minimize these shielding effects include arranging a flow of helium gas across the part of the tape surface on which the UV light is incident, so as to sweep away and remove the debris, and assist in dissipating the plasma rapidly at the end of a pulse, and also to operate the system with the target not under highly reduced pressure but in a helium atmosphere at or approaching atmospheric pressure, which does not affect the emission of X-rays but has the effect of stopping and removing fast ions emitted by the plasma. In spite of such measures, however, it is found that in use of the known apparatus referred to the X-ray pulse generated by a pulse of UV light lasting 20 or 30 nanoseconds is generally limited to a duration of not more than 5 nanoseconds.

This shielding of the target from the incident UV laser light, in the known X-ray source referred to above, and heat loss from the expanding plasma, represent a severe limitation of the "conversion efficiency" (i.e. the ratio of X-ray energy to laser energy) of the apparatus, and a corresponding limitation on its average X-ray output power. These are factors which greatly affect the suitability of such apparatus for use in, particularly, X-ray lithographic work, for example in microcircuit production, where the highest possible average X-ray powers are required in order to minimize processing times.

It has been proposed (App. Phys. Lett. 55 (25), December 1989 and 71 (1), January 1992) to reduce the shielding effect, and improve the conversion efficiency and the average X-ray output power in such apparatus, by arranging that the laser light is emitted not in individual pulses with a pulse duration measured in tens of nanoseconds but in trains of ten to fifteen substantially shorter pulses, each pulse having a duration of about 0.10–0.15 nanoseconds, with the overall duration of the pulse train being about 20 to 30 ns. This proposal enables the conversion efficiency and average X-ray output power, when comparing a pulse train of 20 or 30 ns duration with a single pulse of equal length, to be increased significantly, by a factor of about three; but further improvements in these respects is required to make apparatus of this kind practical and competitive, and it is an object of this invention to provide such further improvements in a substantial degree.

SUMMARY OF THE INVENTION

The invention is based on the discovery that a substantial and surprising further increase in conversion efficiency and average X-ray output power can be achieved by employing a laser light source which generates trains of pulses in which the individual pulses have a much reduced duration, being in the range 1–10 ps instead of the 0.10–0.15 nanosecond pulse duration suggested as noted above. The resulting improvement, even before advantage is taken of other novel features incorporated into preferred embodiments, may amount to a further increase by a whole order of magnitude in the conversion efficiency and in the average X-ray output power.

According to the invention, therefore, there is provided an X-ray source comprising a target, a laser light source and means for focussing light from the light source on to the target, thereby to heat a region of the target and generate therefrom a plasma adjacent thereto which emits X-rays, wherein the laser light source is designed to generate trains of light pulses each having a pulse duration in the range 1–10 picoseconds.

Preferably, the laser light source is designed to generate trains of pulses of ultraviolet light; and also, preferably, it is designed to have an output power such that the light from it, focussed on the target, will illuminate the region of the target with an irradiance sufficient to generate X-rays at a wavelength equal to or less than one nanometer. Preferably, also, the laser light source is designed to generate trains of pulses with a pulse repetition time in the range 1.5–2.5 nanoseconds, and with a pulse train repetition rate in the range 100–10000 Hz, as appropriate to the lasers employed. The target, preferably, comprises a band or tape of target material, guide means supporting a part of the band or tape which includes the region of the target, and transport means arranged to move the tape over the support means; and preferably the guide means is apertured, behind the region of the target, to allow the escape through the guide means of target debris produced on perforation of the target by laser light focussed thereon.

In known manner, the target will normally be housed within a chamber containing gas, but this is preferably at approximately atmospheric pressure so as to reduce the range of travel of debris ejected from the target when subjected to the laser light focussed thereon. In known manner the target will normally be focussed within a chamber containing gas, but this is preferably at approximately atmospheric pressure so as to reduce the range of travel of debris ejected from the target when subjected to the laser light focussed thereon. Preferably also, means is provided for blowing a current of gas over the surface of the region of the target. The laser light source may, in known manner, include multiplexer means for converting a single pulse having a pulse duration in the range 1–10 ps into a train of such pulses, and according to a further feature of the invention at least some of these pulses are differentiated from one another by a directional inequality between them such that the focussing means will focus successive pulses of the train on to closely adjacent but different spots on the target.

The laser light source may also incorporate a variety of advantageous novel and inventive features as disclosed herein.

BRIEF DESCRIPTION OF THE DRAWINGS

The invention will be more fully elucidated in the following description of an X-ray source of known kind as above referred to and of embodiments of improved apparatus in accordance with the invention, with reference to the accompanying drawings, in which FIG. 1 is a diagrammatic representation of a known excimer laser driven X-ray source as described in the published paper above referred to;

DETAILED DESCRIPTION OF PRESENTLY PREFERRED EXEMPLARY EMBODIMENTS

Figure 1:
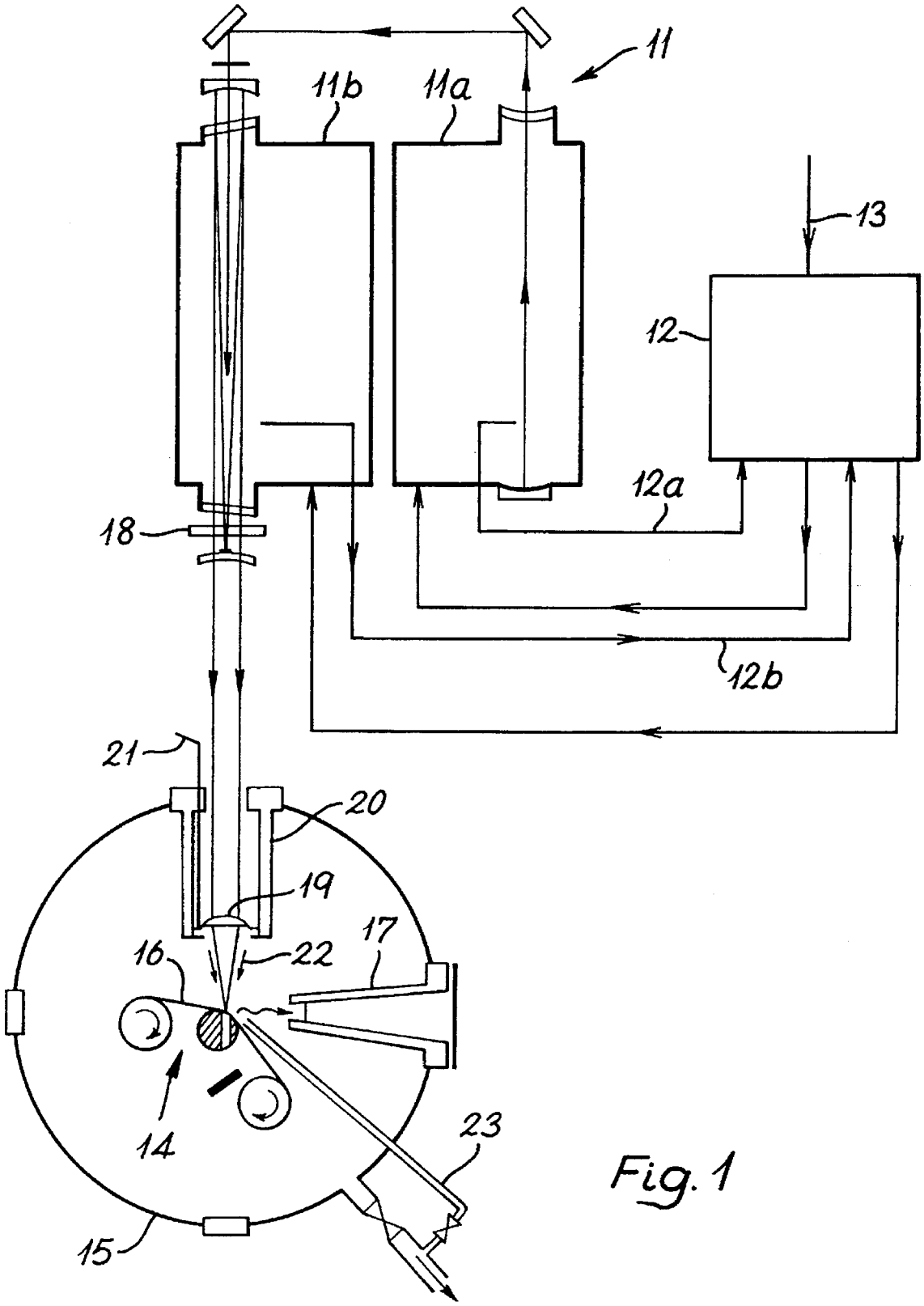

The known excimer laser driven X-ray source disclosed in the paper referred to above comprises, as shown diagrammatically in FIG. 1, an excimer laser system 11 which is controlled by a control unit 12 to which external trigger pulses 13 are applied, and an X-ray target unit 14, housed in a target chamber 15, which includes a target tape 16 on which UV light pulses generated by the laser system 11 are focused to generate X-ray pulses which exit from the chamber 15 through an X-ray "beam line" or outlet port 17.

The laser system 11 consists of two commercially available KrF discharge lasers 11*a* and 11*b* operating as oscillator and amplifier respectively and triggered successively by the control unit 12 in response to a trigger pulse 13 applied to it. The control unit 12 allows adjustment of the delay between the firing of the two lasers so as to optimize the amplification obtained, and feedback signals over optical fibres 12*a* and 12*b* which "see" the two discharges enable the chosen delay to be maintained.

The laser output pulses from the laser amplifier 11*b* are applied, under the control of an electronic shutter 18, to the target tape 16 on which they are sharply focused by a lens 19 mounted in the target chamber 15 by means of a lens holder 20 which permits accurate focusing. With the KrF lasers 11*a* and 11*b* each capable of a pulse repetition frequency of up to 100 Hz and an output rating of 40 W, the laser pulses applied to the target tape 16 may each be of about 18 nanoseconds (ns) pulse duration and an energy of about 350 mJ. With these pulses focused on to a spot of about 9 μm diameter, the resulting irradiance of the target focal spot is about $10^{13}$ W/cm$^2$, which is sufficient to generate X-rays of about 1 KeV, for which the X-ray "beam-line" or outlet port 17 is provided. The X-ray target unit 14, which includes the target tape 16, also includes tape transport means which winds the tape on so that each successive laser pulse is focused on a fresh spot of the tape, which has not been damaged by earlier pulses impinging on it. For further inhibiting a loss of efficiency due to attenuation of the UV light pulses incident on the tape (due partly to shielding by the formation of a plasma over the irradiated spot of the tape and partly to fogging of the optical system, notably surfaces of the lens 19, by debris ejected from the tape) helium is supplied to the interior of the target chamber 15 through an inlet 21 and flows, as indicated by arrows 22, towards the laser-light focal region from where it is removed by an extraction pipe 23 connected to a vacuum pump (not shown) which can also be used, if desired, to maintain a substantially reduced pressure within the target chamber 15.

As referred to above, the "conversion efficiency" (i.e. the ratio of X-ray power to laser power) of the above-described known apparatus is limited due to the fact that progressively increasing attenuation of the laser light incident on the X-ray target during the duration of a laser pulse, due to plasma generation, severely limits the duration of the generated X-ray pulse so that a laser pulse of even 20 ns will generate an X-ray pulse whose duration will not exceed 5 ns. This severely restricts the average X-ray output power of the known apparatus, even if the maximum laser pulse repetition frequency of about 100 Hz is employed. This limits the usefulness of the known apparatus for applications such as microcircuit production by X-ray photolithography, where the highest possible X-ray power is desired in order to minimize processing times.

The embodiment of the invention which will now be described with reference to FIG. 2 incorporates improvements, over the known apparatus, which result in a marked increase in the conversion efficiency which is obtainable and in the average output X-ray power available.

Figure 2:
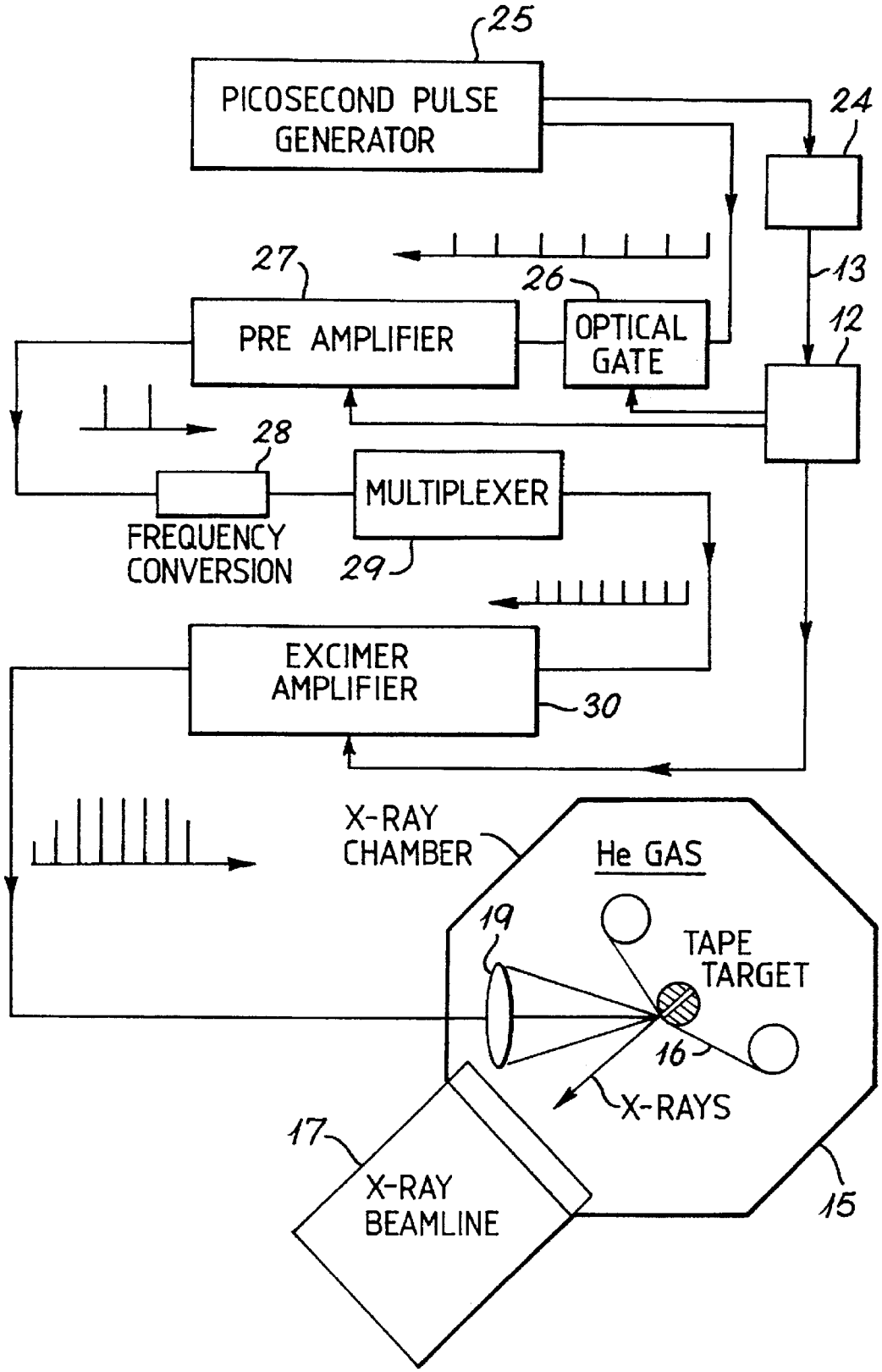
FIG. 2 is a comparable diagrammatic representation of an embodiment of an excimer laser driven X-ray source in accordance with the invention.

The embodiment of the invention which is represented generally in FIG. 2 includes an X-ray target chamber, within which is an X-ray target tape, which are similar to those shown in FIG. 1 and are therefore indicated by the same reference numerals 15 and 16 respectively. The target 16 is irradiated by laser-generated pulses of UV light as in the known apparatus shown in FIG. 1, but the laser section of the apparatus is substantially different from that shown in FIG. 1. As shown in FIG. 2, there is provided a laser pulse generator 25 which generates a continuous train of pulses of visible or infra-red light with a pulse duration of 1–10 picoseconds (psi and a pulse repetition frequency of, say, 80 MHz. The pulses from the pulse generator 25 are counted by a divider 24 which applies trigger pulses 13 at intervals of, say, 1 ms, i.e. as a train of pulses with a repetition rate of 1 KHz. This pulse train, or selected pulses from it, is applied to a synchronization and control unit 12. In response to each trigger pulse 13, the control unit 12 opens an optical gate 26 to apply one pulse from the pulse generator 25 to a laser pre-amplifier 27 which is also triggered with appropriate synchronization by the control unit 12 and which is capable of a repetition rate equal to that of the pulse train applied to it and boosts the energy of each pulse so applied. The output pulses of visible or infra-red light from the pre-amplifier 27 are applied to a frequency converter unit 28 which in turn generates corresponding pulses of UV light (of which the frequency is, for example, two or three times that of the visible or infra-red light). These UV pulses are suitable for amplification in an excimer amplifier, but first these "seed" pulses are passed through an optical multiplexer 29 which converts each seed pulse into a train of, generally, between four and sixteen pulses, with an overall duration longer than the discharge time of the subsequent amplifiers to enable high-efficiency extraction of energy from such amplifiers. It is these trains of pulses, then, which as shown in FIG. 2 are applied to an excimer amplifier 30 (also triggered, with appropriate synchronization, by the control unit 12), the output pulses from which are focused on the target tape 16 by a lens 19 (or alternatively, as will be explained, a mirror, or a plurality of such lenses or mirrors) of the target chamber 15.

Figure 3:
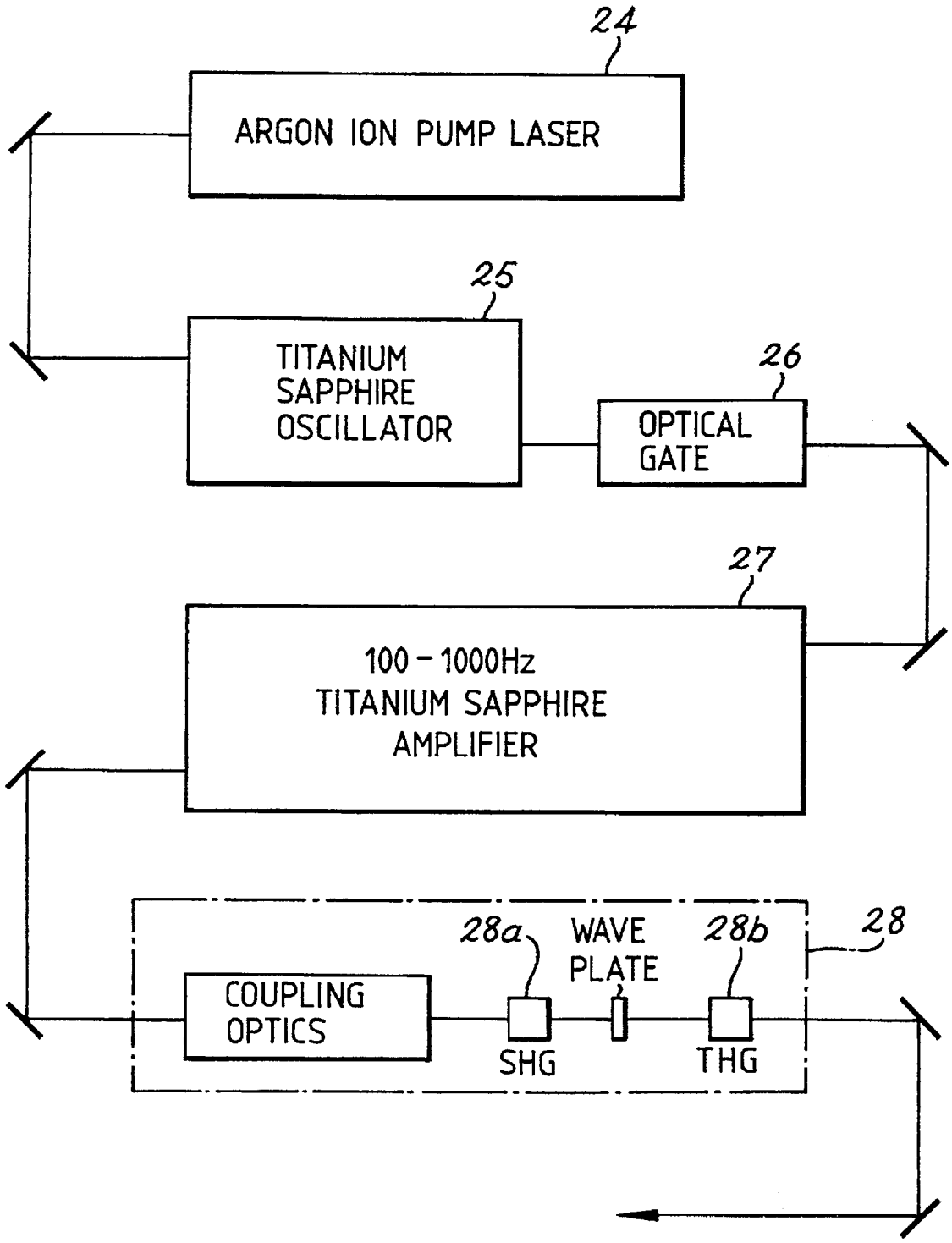
FIG. 3 represents a front-end section of the apparatus shown in FIG. 2, which generates "seed" pulses of UV light of very short duration.

FIG. 3 shows in greater detail the front end of the laser section of the X-ray source shown in FIG. 2. The pulse generator 25 may suitably be pumped by an argon ion or mode-locked neodymium-YAG laser 24 and may itself be a synchronously-pumped and mode-locked dye laser operating at 746 nm or 616 nm for use with KrF or XeCl amplifier, respectively or, as indicated in FIG. 3, may be a mode-locked titanium sapphire laser operating at 746 nm or 924 nm for KrF or XeCl amplifiers respectively. Alternatively, the pulse generator 25 may be flashlamp-pumped or diode-pumped alexandrite, or a laser diode. Selected output pulses from the oscillator 25, of pulse length 1–10 ps and at a repetition frequency of, say, 1 kHz as determined by the optical gate 26, are applied to the pre-amplifier 27, which amplifies each applied pulse to the milli-joule level. The pre-amplifier 27 may suitably be a titanium sapphire or dye-based module or other material such as alexandrite, with a suitably high repetition rate to cope with the maximum repetition rate of pulses applied to it, and its output pulses must be close to the diffraction limit, with good spatial uniformity.

The output pulses from the pre-amplifier 27 are passed via suitable coupling optics to the frequency converter unit 28 in which a non-linear crystal **28*a* serves as a second harmonic generator either alone, to generate 308 nm UV-light pulses from pulses of 616 nm light or, in series with a non-linear crystal 28*b*** serving as a third harmonic generator, to generate pulses of UV light at 249 nm or 308 nm from input light pulses of 746 nm or 924 nm respectively. Suitable crystals are KDP (Potassium Dihydrogen Phosphate) and BBO (β-Barium Borate). Efficient conversion of better than 10% is achieved by proper beam transformation into the crystal and by ensuring that the generated pulses are "bandwidth limited".

Figure 4:
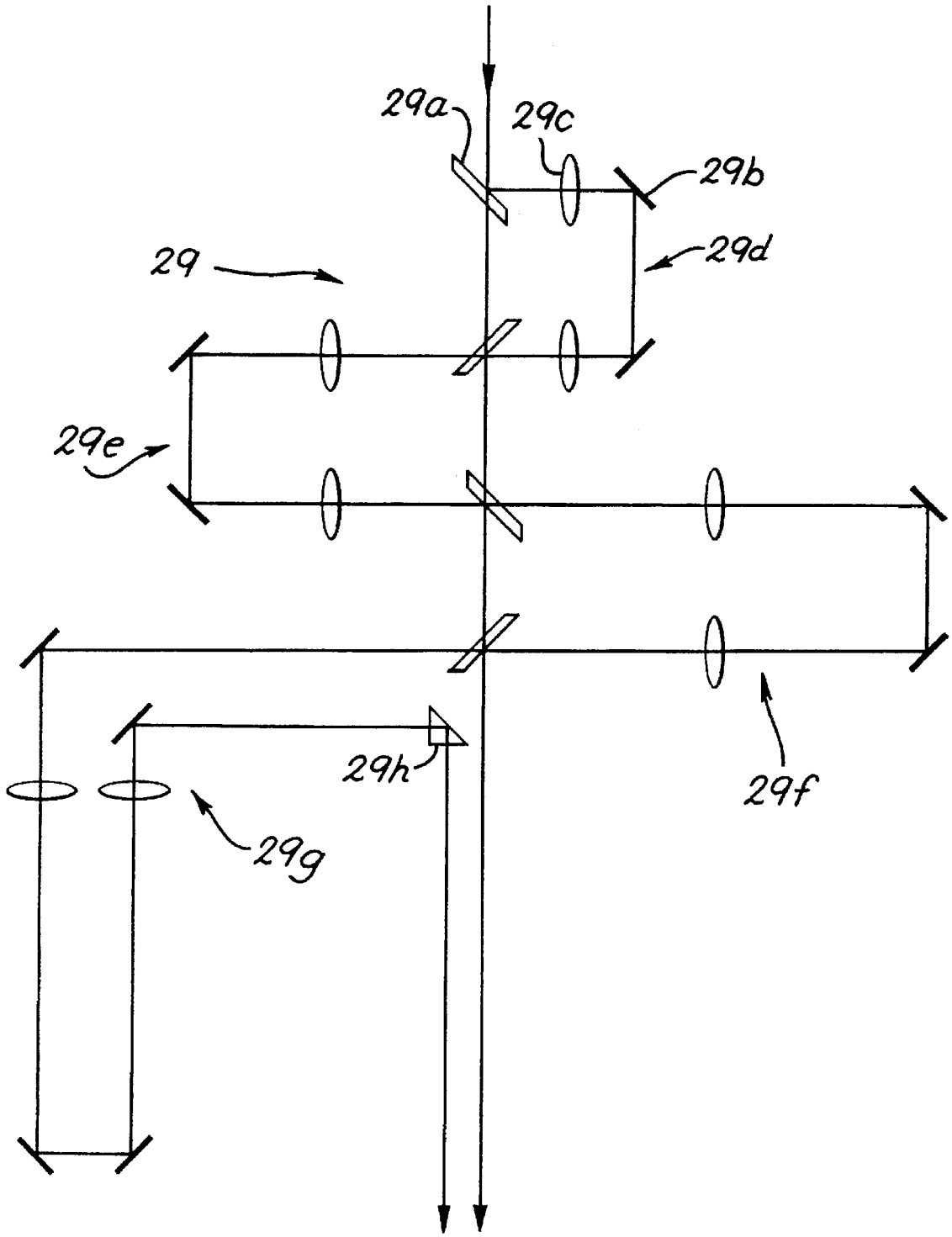
FIG. 4 shows in greater detail an optical multiplexer, shown in FIG. 2, for converting each "seed" pulse into a train composed of a plurality of pulses.

The resulting UV "seed" pulses are applied to the optical multiplexer 29 which may be as illustrated in FIG. 4, which shows four 45° 50% beam splitters **29*a* and a plurality of highly reflecting mirrors 29*b* which, with image relay lenses 29*c*, constitute four optical delay lines 29*d*, 29*e*, 29*f* and 29*g*. It will be understood that a single pulse incident along the vertical axis on the uppermost beam splitter 29*a* will be split into two pulses: a first which proceeds along the vertical axis and a second which traverses the first delay line 29*d* and arrives at the second beam splitter later than the first. Each of the resulting pair of pulses is split, into a first pair which proceed directly to the third beam splitter and a second pair which traverse the delay line 29*e* and therefore arrive at the third beam splitter later than the first pair. The third and fourth beam splitters, and delay lines 29*f* and 29*g*, provide two further doublings of the number of pulses, so that the total effect is to convert a single input pulse into a train of sixteen pulses which will be equally spaced if each delay line produces a delay which is twice that of the preceding one (though that is not an essential feature). As further explained below, the various mirrors may be slightly offset so that some or all of the sixteen pulses emerge along slightly different axes from one another. Whether or not that is so, the prism 29*h* by which pulses from the delay line 29*g*** are combined with the other pulses may be, and preferably is, adjusted so that the two trains of pulses are at a slight angle (approximately 1 mrad) to one another.

The delay lines **29*d*, 29*e*, 29*f* and 29*g*** are such that the separations between successive pulses of the train of sixteen pulses are, preferably, equal and are between, say, 1.5 and 2.5 ns, depending on the population-inversion re-pumping time of the excimer laser amplifiers to which the pulses will be applied.

Figure 5:
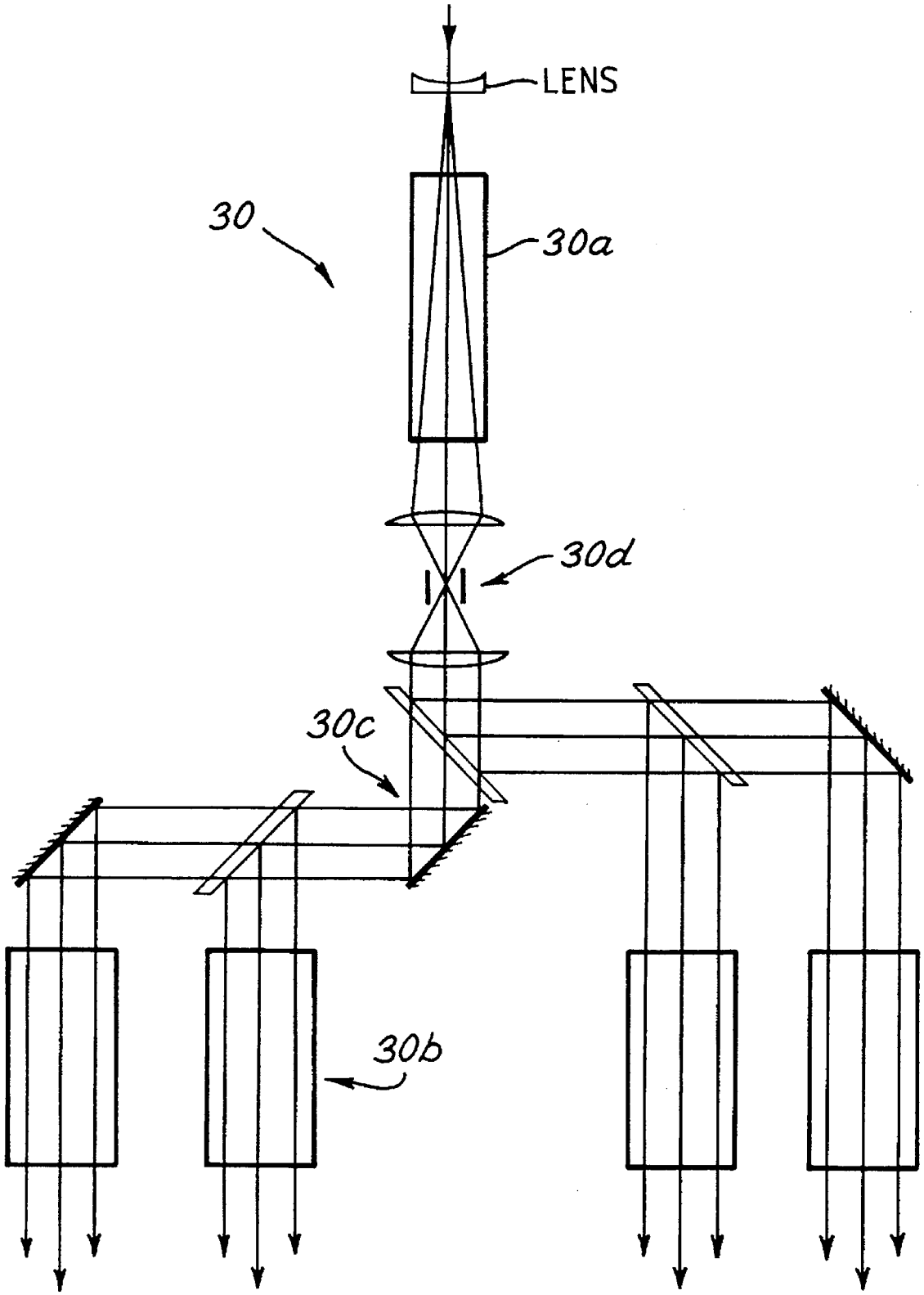
FIG. 5 shows an excimer amplifier, comprised by the apparatus shown in FIG. 2, comprising a driving amplifier laser and a plurality of output amplifier lasers driven thereby.
Figure 6:
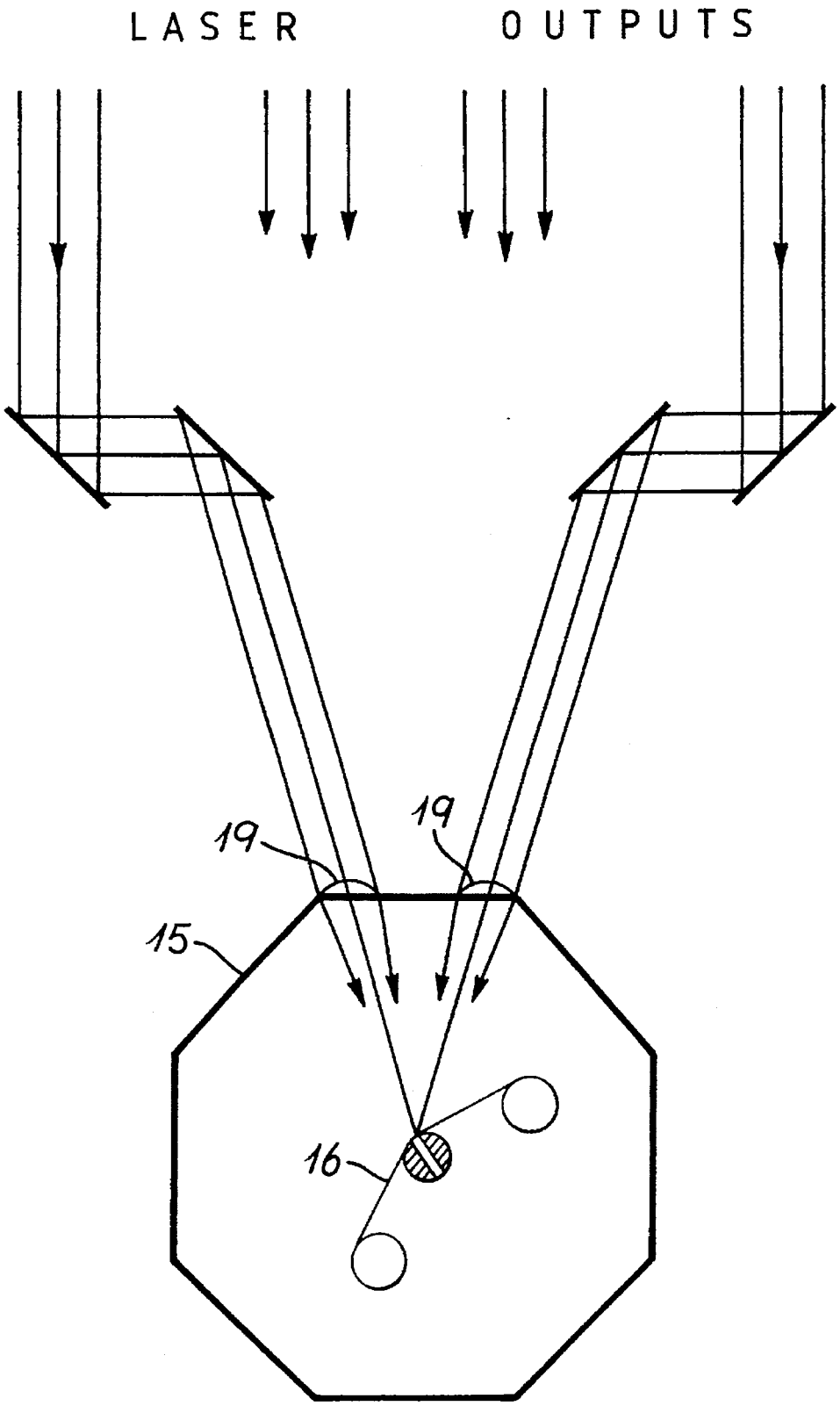
FIG. 6 shows how the laser outputs from the output amplifier lasers shown in FIG. 5 are brought to a common focus at a point or points on an X-ray target of the apparatus shown in FIG. 2.

Each train of pulses from the multiplexer 29 is applied to the excimer amplifier 30 which in one form, as shown in FIG. 5, comprises a driver amplifier **30*a* and a plurality of output amplifiers 30*b* to each of which each output pulse from the driver amplifier 30*a* is applied via a suitable beam splitter assembly 30*c*. The driver amplifier and each output amplifier may all be commercially available excimer amplifiers. The driver amplifier 30*a* first amplifies each pulse to a power level which, after division in the beam splitter assembly 30*c*, will properly saturate each output amplifier 30*b*; and each of these then amplifies to full output. The parallel outputs of the amplifiers 30*b* are then brought together and focused by respective lenses 19 on the target tape, as shown in FIG. 6. As mentioned above, some or all of the individual pulses of each train emerging from the multiplexer 29 may be arranged to follow slightly divergent paths through the driver amplifier 30*a* and, after spatial filtering and recollimation in a spatial filter 30*d*, through the output amplifiers 30*b*, so that different pulses of a given train will be focused on slightly different spots of the target tape 16**. This provision of a train of pulses, each of a duration of ten picoseconds or less, impinging on different parts of the target surface within the bounds of the spot from which it is desired that X-ray emission should take place, has a remarkable effect in improving the conversion efficiency of the device by increasing the temperature of the plasma generated from the target, and reducing the extent to which the target becomes shielded from the incident UV light by a build-up of plasma and also because the shortness of the pulses leads to a more than linear reduction in the amount of debris produced.

Figure 7:
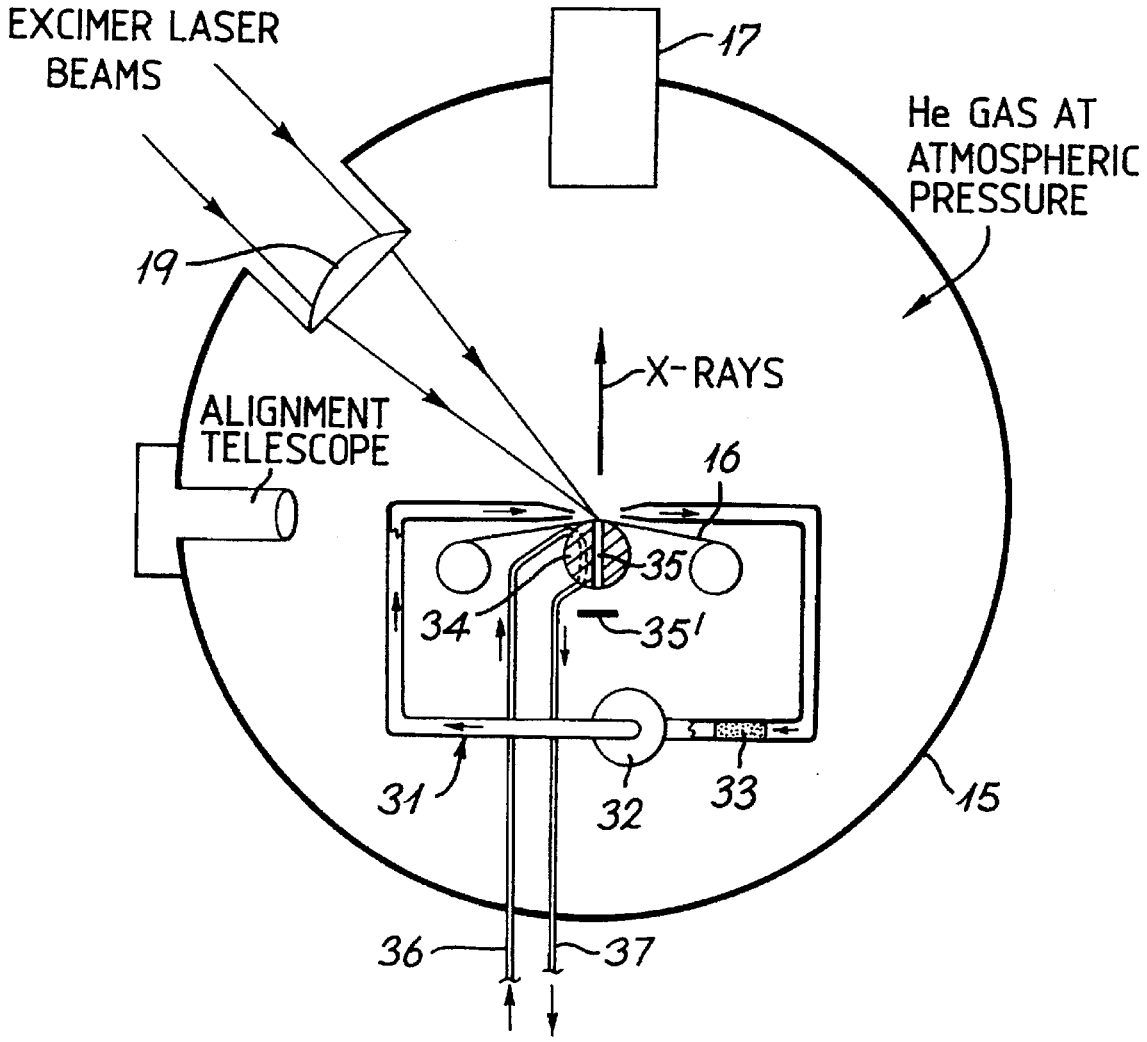
FIG. 7 is a representation of the X-ray target and an enclosing X-ray chamber as shown in FIGS. 2 and 6, showing also a helium-circulating system and a water cooling system associated with the target and guide means therefor, together with other features of the chamber.

FIG. 7 shows various other design improvements which are preferably also incorporated in an X-ray source in accordance with the invention. First, the X-ray beamline or outlet port is preferably arranged to accept X-rays emitted normally from the part of the target tape 16 on which the laser light is incident, thereby maximizing the useful X-ray emission. Secondly, the laser illumination from the lenses 19 is arranged to impinge non-normally on the tape 16, conveniently at about 45° as shown, and this allows the use of the target normal direction for location of the X-ray beam line 17 and minimizes the extent to which the lenses become coated or fogged by debris ejected from the target, since ejection of debris also tends to be a maximum on the surface normal. Also, atomic debris emission is minimized by the use of very short laser pulses and of a thin (5–15 pm) tape target, and by maintaining a helium atmosphere within the target chamber at about atmospheric pressure; and a vigorous recirculating helium flow over the target area of the target tape 16, which is provided by a helium circulation system 31 which includes a pump 32 and a filter 33, is effective to remove and capture much of such debris as does form, thus to prevent it from fogging the optical system. Preferably the tape 16 passes over a stationary guide rod 34 which supports and accurately locates the target zone of the tape on which the laser illuminating on is focussed, and the guide rod is pierced, behind the tape target zone, by a through slot 35 which,in the event that the tape is punctured by the incident laser illumination, with production of actual droplets of molten material or other relatively large pieces of "cluster debris", allows such cluster debris to escape through the slot 35 rather than being expelled in a direction towards the lens 19 or the X-ray beam line 17. The amount of cluster debris produced is in any case minimized if a thin target tape is used, as referred to above.

The tape transport mechanism 14 is a reel-to-reel type, with accurate positioning of the tape round the guide rod 34 so that movement of the tape in the direction of the laser beam axis is less than 5 μm during operation. The curved path of the tape round the guide rod facilitates the arrangement of the intake and outlet nozzles of the helium circulation system 31 directly opposite one another so as to produce a highly laminar and highly effective debris-scavenging flow over and parallel to the surface of the target zone part of the tape. Start, stop and reverse functions of the tape transport mechanism ensure smooth operation without stretching or breaking of the tape. The design preferably allows a number of tracks along each tape, to maximize the use to be had from each tape and provide long running times between tape changes; and preferably also the tape is arranged to move only during exposure to laser light so that no tape is used when no X-ray output is required. Preferably the tape consists of thin (5–10 μm) metal (e.g. soft copper) either alone or as a substrate on which a thin, say 3 μm, layer of the desired X-ray target material is deposited by electroplating, evaporation or other convenient method. Preferably the guide rod 34 is provided with water cooling means, as indicated schematically by the provision of water inlet and outlet tubes 36 and 37 accessible from outside the target chamber 15 for circulation of cooling water.

An advantage of maintaining at least approximately atmospheric pressure within the target chamber 15 is that the X-ray window of the X-ray beam line or exit port 17 may be made extremely thin so as to minimize its X-ray opacity.

As shown in FIG. 7, the axis of the beam line 17 and x-rays emitted through it is vertical, and this is a very convenient feature use for X-ray lithography of microcircuits, as in full scale VLS1 processing where the lithography stage should be horizontal to preserve accuracy, or in radiobiology, where a layer of living cells is maintained under the cover of a layer of water.

Figure 8:
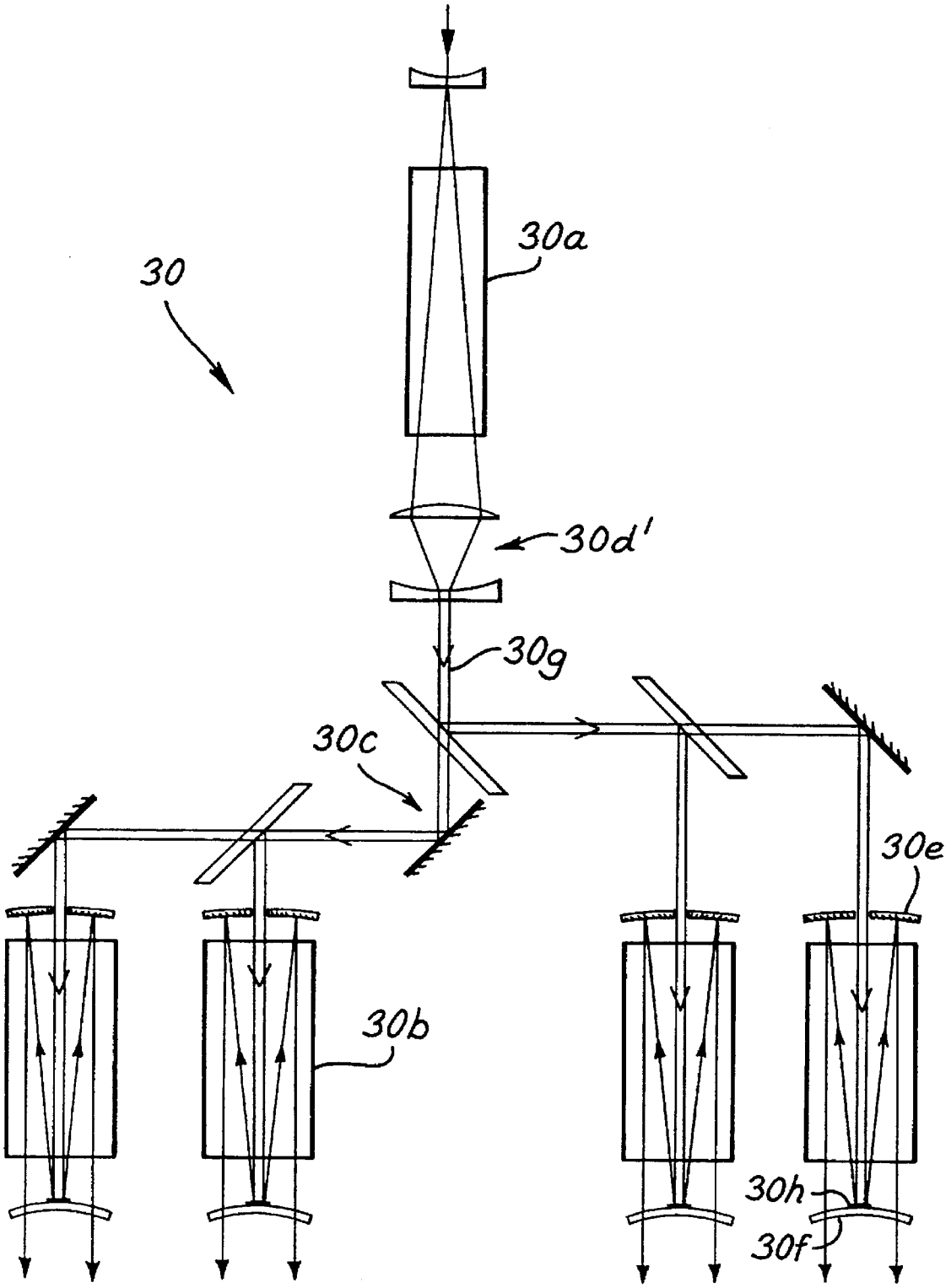
FIGS. 8, 9 and 10 show alternatives which may, if desired, be provided in place of parts of the embodiment of the invention represented in FIG. 2.

In a modification of the system according to the invention described above, the output amplifiers **30*b* of the excimer amplifier 30 shown in FIG. 5 may, as illustrated in FIG. 8, be arranged as injection-mode-locked unstable resonant excimer amplifiers each having a centrally apertured concave mirror 30*e* at its input end and a partially reflective convex mirror 30*f* at its output end. The spatial filter collimator 30*d* shown in FIG. 5 is replaced by a collimating system 30*d'* which converts the output of the driver amplifier 30*a* into a narrow parallel beam 30*g* of only, say, some 2 mm diameter; and this beam, after splitting by the beam splitter assembly 30*c*, passes through the central apertures of the mirrors 30*e* to pass through the lasers 30*b* and be partially reflected by the mirrors 30*f* and re-reflected by the mirrors 30*e*. The mirrors 30*f* may be of calcium fluoride without any added reflective coating, since the inherent partial reflectivity of their surfaces of about 4% per surface is adequate, view of the high gain of the amplifiers 30*b*. Alternatively each mirror 30*f* may have a central spot 30*h* of fully reflective coating; and the mirrors 30*e* are fully reflective. It is arranged that the laser cavity length, between each pair of mirrors 30*e* and 30*f*, is such that the round-trip time for light injected and reflected is equal to an integral multiple of the time interval between successive pulses of the injected pulse trains (this time interval will usually be between 1.5 and 2.5 nanoseconds) and that the duration of each injected train of pulses is longer than the round trip time. With the amplifiers 30*b* synchronously triggered by the control unit 12** at the appropriate times, a complete train of output pulses, lasting the whole of the laser discharge time, can be obtained from a shorter train of the injected pulses, and yet can achieve a highly efficient extraction of the laser amplifier stored energy.

Figure 9:
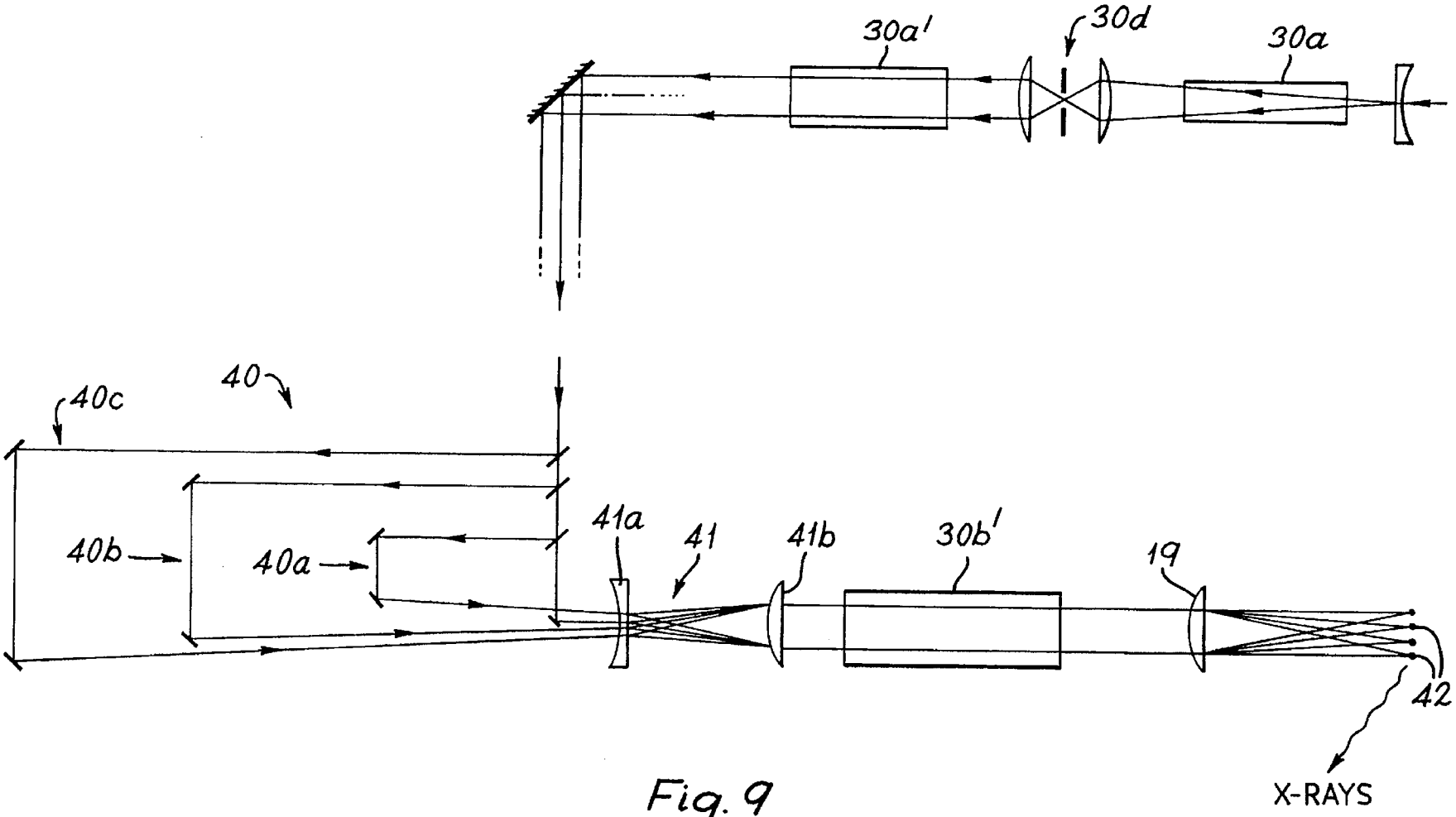

A further alternative embodiment of the excimer amplifier 30 of FIG. 2 is illustrated in FIG. 9. In that FIG., the train of sixteen pulses from the multiplexer 29 of FIG. 2 (which may be 1 μJ pulses of 5 ps duration, with a pulse train duration of 25–30 ns) passes into the driver amplifier **30*a* shown in FIG. 9. The discharge time of the amplifier 30*a* is about 22 ns, and its train of output pulses therefore contains only about 12 pulses of about 1 mJ per pulse, which pass through the spatial filter and collimator 30*d* into a second driver amplifier 30*a*'. The output from the amplifier 30*a*' is a train of about twelve 5 ps pulses of amplified energy of about 30 mJ per pulse, adequate even after a further multiplexing stage to drive the high-power amplifier 30*b*' about to be described. The train of pulses from the amplifier 30*a*' is multiplexed by a multiplexer 40 with three delay arms 40*a*, 40*b* and 40*c* with respective delays of 20 ns, 40 ns and 60 ns, such that each pulse train of 20 ns duration from the amplifier 30*a*' is converted into a pulse train of 80 ns duration containing approximately 48 5 ps pulses, whose energy is reduced by the beam splitting to about 7 mJ per pulse. Furthermore the delay arms 40*a*, 40*b* and 40*c* are each arranged to introduce between the respective delayed pulse trains a small angular divergence of the order of 1 mrad from one another and from the undelayed train of pulses, resulting in four beams. If the multiplexer 29, which provides the input pulse train to the amplifier 30*a*, is also arranged by adjustment of its prism 29*h* to provide that pulse train in two beams at a slight angle to one another, the 80 ns pulse train emerging from the multiplexer 40** will be subdivided angularly into eight beams, rather than four.

The 80 ns pulse train from the multiplexer 40 may have a cross-sectional area of about 1.3×2.5 $cm^2$, determined by the aperture of the amplifier **30*a*', and is passed through a telescope 41, comprising lenses 41*a* and 41*b*, to expand its area to, say, 6×8 $cm^2$ so as to match it to a larger-area output amplifier 30*b*'. The telescope 41 also has the effect of reducing the angle between the beams by a factor equal to the power of the telescope, and of spatially mixing the beams to propagate them as, effectively, a single beam through the amplifier 30*b*'** and filling its aperture for maximum energy extraction.

The output from the amplifier 30b', consisting of trains of 48 pulses each of energy about 150 mJ per pulse, is focussed by the lens 19 on to the X-ray target (tape 16), forming four or eight focussed spots 42, each corresponding to one of the angularly separated pulse trains produced by the multiplexer 40 and also, possibly, 29. The distribution of the spots 42 can be controlled by choice of the geometry of the multiplexers 40 and 29.

If the large-area output amplifier 30b' gives an average power of 1 KW when operated at 100 Hz with stable laser cavity and 80 ns pulses of 10 J per pulse, then an average power of 720 watt may be obtained when the amplifier is operated as described above, with trains of 48 5 ps pulses and a train repetition rate of 100 Hz; and this will result in an average X-ray power, within the spectral range 0.9–1.2 nm, of 36 watts at 5% X-ray conversion efficiency.

It will be understood that the train of sixteen pulses issuing from the multiplexer 29 shown in FIG. 4, in response to a single input pulse on the mirror 29a, consists of two successive sub-trains each of eight pulses, of which the second sub-train has been delayed by the delay line 29g relative to the whole of the first sub-train, and that the overall duration of the train will be 32 ns if the pulse separation is 2 ns. Thus if the discharge time of the amplifier 30a to which the pulse train is applied is about 22 ns, the amplified output pulse train will contain about twelve pulses at most. If the discharge times of the output amplifier 30b are also about 22 ns, any jitter in the firing of these amplifiers will result in less than all the pulses being amplified and in a reduction of the energy extracted from the amplifier. In the modified arrangement shown in FIG. 10, a multiplexer 29' produces two simultaneous pulse sub-trains, each of eight pulses, which are then propagated simultaneously in opposite directions through the driver amplifier 30a prior to being combined into a single train of sixteen pulses of which the second sub-train of eight pulses is delayed relative to the first sub-train and is arranged to be propagated at a small angle (of about 1 mrad) relative to the first sub-train. It will be appreciated that in this arrangement, there is ample time for all eight pulses of each sub-train to be fully amplified during discharge of the driver amplifier 30a, and that all sixteen pulses are preserved, amplified, in the recombined pulse train.

Figure 10:
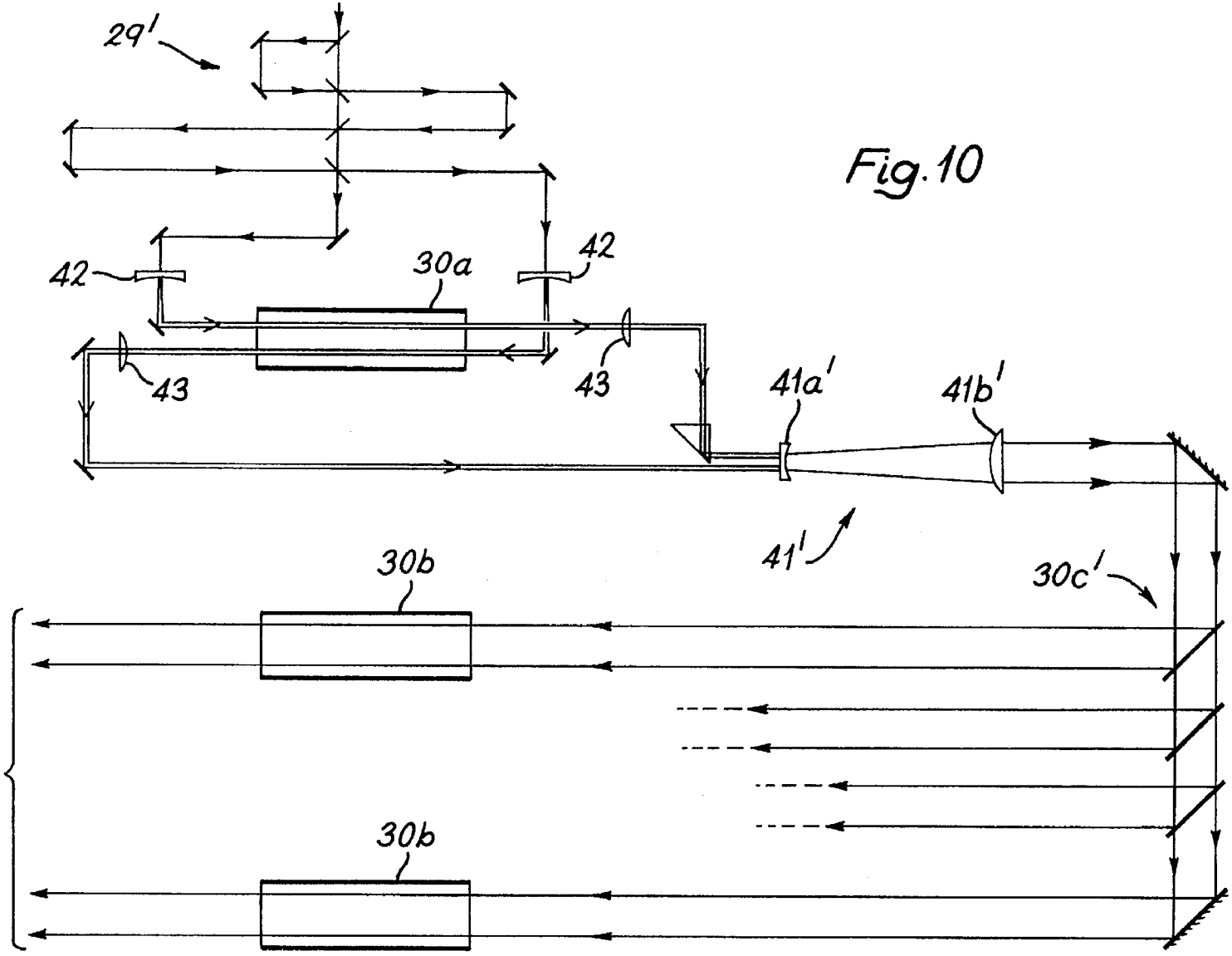

In the arrangement shown in FIG. 5, the lenses provided before and after the amplifier 30a have a telescopic effect corresponding to that of the telescope 41 in FIG. 9, and a corresponding telescopic effect may be associated with the amplifier 30a in FIG. 10 by providing lenses 42 and 43 before and after this amplifier to provide a first beam expansion from about 1 mm to 4 mm diameter through the amplifier 30a. Preferably, also, a further expansion of the recombined full pulse train emitted from the amplifier 30a is provided by passing it through a telescope 41', combining lenses 41a' and 41b', for spatial mixing of the two sub-trains and for expanding the beams for matching the apertures of output amplifiers 30b to which the pulse train is then applied via a beam splitter arrangement 30c' which divides the pulse energy equally between those amplifiers. The combined expansion provided by the lenses before and after the driver amplifier 30a and by the telescope 41' may be equal to that produced by the lenses before and after the driver amplifier 30a in FIG. 5, if the output amplifiers in FIGS. 5 and 10 have comparable apertures, which may for example be 1.3×2.5 $cm^2$.

As explained above, the pulse train applied to the beam splitter 30c' contains a full sixteen pulses and has a train duration of approximately 32 ns, and this is sufficient to accommodate any jitter in the firing of the output amplifiers 30b, and to ensure full energy extraction over the whole duration of the amplifier discharge.

The pulses applied to the driver amplifier 30a, as two simultaneous but oppositely directed sub-trains each of eight pulses, may be 1 μJ pulses each of 5 ps duration and with a sub-train duration of 12–15 ns. The pulses are amplified to about 4 mJ each by the amplifier 30a, and one sub-train is delayed relative to the other by a time equal to eight times the pulse repetition time before recombination to provide a single pulse train of sixteen pulses, with a pulse train duration of 24–30 ns. The beam splitter 30c' divides the energy of each pulse equally between the output amplifiers 30b; If there are four of these, each will receive a train of sixteen 5 ps pulses, each of energy about 1 mJ with a pulse train duration of 24–30 ns which is comfortably longer than the discharge time of the amplifiers 30b, which is about 20 ns. The firing of the amplifiers 30b under control of the control unit 12 can therefore be synchronized so that, even allowing for jitter, pulses of the train are applied throughout the amplifier discharge time so as to achieve maximum energy extraction from each amplifier 30b.

The output of each amplifier 30b will be a train of about 20 ns duration, containing about 12 (perhaps 11 or 13) pulses. If each of the amplifiers 30b is a "200 watt output amplifier", i.e. one which can deliver 200 watt when arranged conventionally with plane mirrors and a stable cavity, and pulsed with 22 ns pulses at 200 Hz, it will be capable of delivering 140 watt average power when operated as described above, with nanosecond pulses at 200 Hz replaced by trains of picosecond pulses and a pulse-train repetition rate of 200 Hz. Thus four such amplifiers 30b in parallel can deliver a total of about 560 watt average power for focussing on the target tape in a single spot or, by angular beam separation as described with reference to FIG. 9, in a cluster of spots 42. At an X-ray conversion efficiency of 5%, this will yield 28 watts X-ray average power in a spectral range of 0.9–1.2 nm.

We claim:

1. An X-ray source comprising:

a target;

a laser light source; and means for focusing light from the light source on to the target, thereby to heat a region of the target and generate therefrom a plasma adjacent thereto which emits X-ray;

wherein the laser light source generates trains of light pulses each having a pulse duration in a range 1–10 picoseconds.

2. An X-ray source as claimed in claim 1, wherein:

the laser light source generates trains of pulses of ultra-violet light.

3. An X-ray source as claimed in claim 1 or claim 2, wherein:

the laser light source has an output power such that light therefrom focussed on the target will illuminate the region of the target with an irradiance to generate X-rays at a wavelength no greater than one nanometer.

4. An X-ray source as claimed in claim 1, wherein:

the laser light source generates trains of pulses with a pulse repetition time in a range 1.5–2.5 nanoseconds.

5. An X-ray source as claimed in claim 1, wherein:

the laser light source generates pulse trains with a pulse train repetition rate in a range 100–10000 Hz.

6. An X-ray source as claimed in claim 1, wherein the target comprises:

one of a band and a tape of target material;

guide means supporting a part of the target material which includes the region of the target; and transport means arranged to move the target material over the guide means.

7. An X-ray source as claimed in claim 6, wherein:

the guide means is apertured, behind the region of the target, to allow target debris, produced on perforation of the target by laser light focussed thereon, to escape through the guide means.

8. An X-ray source as claimed in claim 1, wherein:

the target is housed within a chamber containing gas, at approximately atmospheric pressure, which reduces a range of travel of debris ejected from the target when subjected to laser light focussed thereon.

9. An X-ray source as claimed in claim 1, further comprising:

means for blowing a current of gas over a surface of the region of the target.

10. An X-ray source as claimed in claim 6, wherein:

the laser light is arranged to impinge obliquely on the region of the target; and an X-ray beam line is arranged on a normal from the region.

11. An X-ray source as claimed in claim 1, wherein:

successive pulses of a train of pulses are focussed at different points of the target.

12. An X-ray source as claimed in claim 11, wherein the laser light source comprises:

multiplexer means for converting a single pulse having a pulse duration in the range 1–10 ps into a train of such pulses with a directional inequality between at least some of the pulses such that the means for focussing will focus successive pulses of the train on to closely adjacent but different spots on the target.

13. An X-ray source as claimed in claim 1, wherein the laser light source comprises:

means for generating the trains of light pulses; and amplifier means arranged to amplify the pulses prior to their being focussed on the target.

14. An X-ray source as claimed in claim 13, wherein the amplifier means comprises:

a driver-stage excimer amplifier arranged to provide a first amplification of the pulses;

beam splitting means arranged to split each pulse train into a plurality of pulse trains in parallel;

a plurality of output-stage excimer amplifiers each arranged to receive and further amplify a respective one of the pulse trains in parallel; and means for focussing outputs of all the output-stage amplifiers on the target.

15. An X-ray source as claimed in claim 13, wherein the amplifier means comprises:

a driver-stage excimer amplifier;

beam splitter means arranged to split each pulse train into two pulse trains and pass the two pulse trains simultaneously in opposite directions through the driver-stage excimer amplifier to provide a first amplification of the pulses of both trains;

means for delaying one of the amplified trains relative to the other and combining them in a single combined pulse train in which the pulses of the one train are preceded by those of the other;

at least one output-stage excimer amplifier each arranged to receive (via a beam splitter if more than one) and further amplify the combined pulse train; and means for focussing outputs of the at least one output-stage excimer amplifier on the target.

16. An X-ray source as claimed in claim 13, wherein the amplifier means comprises:

a driver-stage excimer amplifier arranged to provide a first amplification of the pulses of the train;

multiplexing means arranged to convert the thus amplified train into a plurality of trains delayed relative to one another;

means arranged to combine the plurality of trains sequentially one after another to form a combined pulse train of correspondingly increased length; and a high-power output-stage excimer amplifier having a long discharge time, arranged to receive and further amplify pulses of the combined pulse train, the combined pulse train effecting discharge of the high-power output-stage excimer amplifier.

17. An X-ray source as claimed in claim 16, wherein:

the multiplexing means which provides the plurality of trains forming the combined pulse train is so arranged that the plurality of trains pass through the output stage along respective optical axes which are angularly displaced from one another.

18. An X-ray source as claimed in claim 17, wherein:

the plurality of trains forming the combined pulse train are beam-expanded and spatially mixed to fill an aperture of the output amplifier by a telescope which also collimates a beam of each train and reduces angles between their respective optical axes.

19. An X-ray source as claimed in 18, further comprising:

means for focussing the further amplified combined train, issuing from the output amplifier, at a plurality of spots on the target, corresponding to the plurality of optical axes of the plurality of trains forming the combined train.

* * * * *